US008272185B2

(12) United States Patent
Orava

(10) Patent No.: US 8,272,185 B2
(45) Date of Patent: Sep. 25, 2012

(54) METHOD OF NEUTRALIZING A HARMFUL SUBSTANCE USING RESPONSIVE STRUCTURAL ELEMENTS

(75) Inventor: John Edward Orava, Edgewood, IL (US)

(73) Assignee: Orava Applied Technologies Corporation, Albany, NY (US)

( * ) Notice: Subject to any disclaimer, the term of this patent is extended or adjusted under 35 U.S.C. 154(b) by 0 days.

(21) Appl. No.: 11/911,284

(22) PCT Filed: Apr. 12, 2006

(86) PCT No.: PCT/US2006/014025

§ 371 (c)(1), (2), (4) Date: Oct. 11, 2007

(87) PCT Pub. No.: WO2007/027212

PCT Pub. Date: Mar. 8, 2007

(65) Prior Publication Data

US 2008/0202038 A1 Aug. 28, 2008

Related U.S. Application Data

(60) Provisional application No. 60/670,569, filed on Apr. 12, 2005.

(51) Int. Cl.
*E04H 9/16* (2006.01)

(52) U.S. Cl. ..... 52/741.1; 52/1; 52/302.3

(58) Field of Classification Search .. 52/1, 731.2–731.5, 52/732.1–732.3, 302.1, 302.3, 302.4, 834, 52/843–845, 168, 741.1
See application file for complete search history.

(56) References Cited

U.S. PATENT DOCUMENTS

| | | | | | |
|---|---|---|---|---|---|
| 684,116 | A | * | 10/1901 | Siegwart | 52/302.4 |
| 769,257 | A | * | 9/1904 | Ewing | 52/302.4 |
| 2,922,200 | A | * | 1/1960 | Atwood et al. | 52/834 |
| 4,143,703 | A | * | 3/1979 | Creswick et al. | 52/168 |
| 4,617,777 | A | * | 10/1986 | Fonne et al. | 52/792.1 |
| 5,398,462 | A | * | 3/1995 | Berlin et al. | 52/1 |
| 5,593,744 | A | * | 1/1997 | Van Vechten et al. | 52/726.1 |
| 7,096,125 | B2 | * | 8/2006 | Padmanabhan et al. | 702/24 |
| 7,127,850 | B1 | * | 10/2006 | Fex, Jr. | 52/1 |

* cited by examiner

*Primary Examiner* — William Gilbert
*Assistant Examiner* — Matthew J Smith
(74) *Attorney, Agent, or Firm* — Schmeiser, Olsen & Watts, LLP

(57) ABSTRACT

The invention is a structural element including an elongate member having a first end and second end and defining a cross-section. The structural element further includes a sensor, secured to the elongate member, for detecting at least one pre-selected indicator. Advantageously, the elongate member is responsive to the pre-selected indicator.

9 Claims, 4 Drawing Sheets

METHOD OF NEUTRALIZING A HARMFUL SUBSTANCE USING RESPONSIVE STRUCTURAL ELEMENTS

CROSS REFERENCE TO RELATED APPLICATION

This application hereby claims the benefit of commonly owned pending U.S. Provisional Patent Application Ser. No. 60/670,569, for Dynamically Responsive and Interactive Construction Element(s), filed Apr. 12, 2005.

BACKGROUND OF THE INVENTION

The present invention relates to the field of structural elements. More specifically, the invention relates to the field of novel structural elements for use in construction applications.

Elements utilized in the construction of foundations, floors, walls, partitions, ceilings, and roofs are typically referred to as structural, or construction, elements. Typical structural elements include lumber, concrete, brick, tile, block, metal, plywood, particleboard, flakeboard, insulation board, fiberglass, cellulose, sawdust, natural fibers, mineral fibers, drywall, plaster, stucco, and other similar materials known in the art.

Typical structural elements are static, or non-responsive, to their environment. For example, typical structural elements may allow harmful gases, vapors, bacteria, viruses, and spores to lodge within the structural elements and penetrate the structural elements into an internal environment within a structure. As is known to those having ordinary skill in the art, such penetration may affect the health and well-being of occupants of a structure. This penetration may also damage objects within a structure. Additionally, such penetration may weaken the structure, eventually leading to structural failure.

Another drawback to the use of typical structural elements is their inability to dynamically react to, and compensate for environmental changes which may include, but are not limited to, changes in one or more of temperature, pressure, electromagnetic radiation, visible light, nuclear radiation, gases, vapors, liquids, particulate matter, biological agents, viruses, bacteria, poisons, explosive overpressure, and other changed external conditions.

As a result of the typical structural elements' inability to block or absorb harmful substances from entering an internal environment, or adjust to environmental changes, known structural elements typically do not provide an enhanced layer of security and safety. For example, typical structural elements may be incapable of protecting occupants of a building from a bioweapon attack. Similarly, many homes suffer from mold infestations that manifest themselves slowly until the home must be destroyed and rebuilt.

Known structural elements are also inefficient due to their inability to respond to the previously discussed environmental changes. For example, typical structural elements are unable to effectively block water penetration. Similarly, the rigidity of typical structural elements decreases the ability of a structure to withstand high winds. As a result of this inability to adjust, homes are more likely to be destroyed during major climactic events, such as tornadoes, hurricanes, earthquakes, and floods due to their static, inflexible nature.

SUMMARY OF THE INVENTION

In one aspect the invention is a structural element including an elongate member having a first end and second end and defining a cross-section. The structural element further includes a sensor, secured to the elongate member, for detecting at least one pre-selected indicator. Advantageously, the elongate member is responsive to the pre-selected indicator.

In another aspect, the invention is a structure including at least one elongate member having a first end and a second end, and defining a cross-section, an internal surface, and an external surface. The structure further includes a sensor, secured to at least one of the surfaces of the elongate member. The sensor is capable of communicating with one or more of the elongate members and capable of detecting at least one pre-selected indicator. The structure may also include a connector for securing at least one elongate member to at least another elongate member. Advantageously, the elongate member forming the structure is responsive to the pre-selected indicator.

In yet another aspect, the invention is a method of protecting an internal environment. The method includes the steps of providing a plurality of elongate members and at least one sensor, and assembling the elongate members into a structure such that the sensor is secured to at least one of the elongate members. The method further includes the step of engaging the sensor to detect at least one of the pre-selected indicators and to respond to the indicator, such that the sensor facilitates maintenance of a desired internal environment within the structure.

The foregoing, as well as other objectives and advantages of the invention and the manner in which the same are accomplished, is further discussed within the following detailed description and its accompanying drawings.

BRIEF DESCRIPTION OF THE DRAWING

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements.

DETAILED DESCRIPTION

The invention relates to the construction of structures and elements used in construction. More specifically, the invention relates to dynamically responsive and interactive structural elements for improving structural performance, providing increased safety, improving comfort, and reducing operating costs.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

For ease of discussion, the method and apparatus will be described with reference to housing construction elements. Those having ordinary skill in the art will recognize that the invention is applicable to construction elements for structures other than housing structures, such as commercial buildings and other buildings known in the art. Similarly, the method will be described with respect to housing construction for ease of discussion. Those having ordinary skill in the art will recognize that the invention is applicable to construction of other buildings, such as commercial structures, and shall not be so limited.

Figure 1:
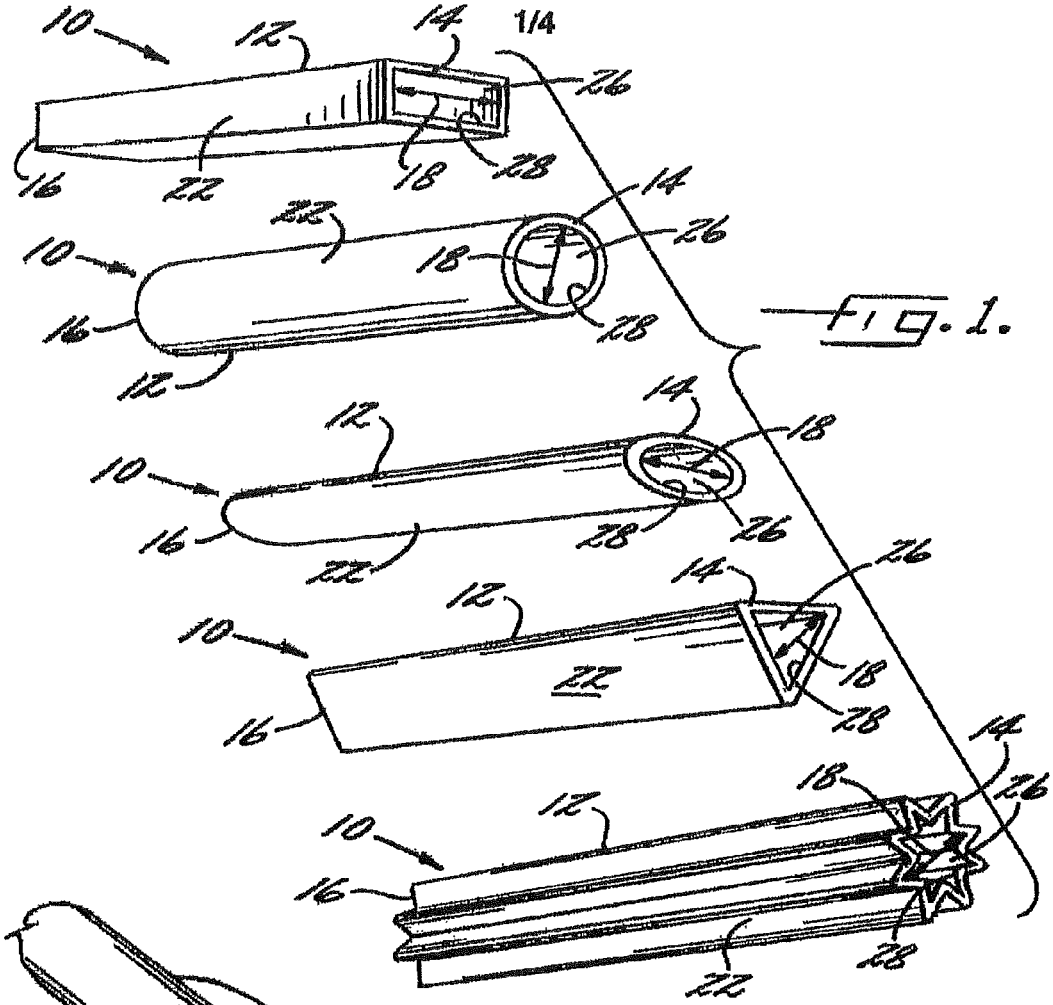
FIG. 1 is perspective view of representative elongate members in accordance with the present invention.

In one aspect, the invention is a single structural element. As depicted in FIG. 1, the structural element 10 includes an elongate member 12 having a first end 14 and a second end 16, and defining a cross-section 18. The elongate member 12 may be made from any number of materials, such as one or more materials including, but not limited to, wood, concrete, brick, tile, metal, fiberglass, particleboard, flakeboard, plywood, insulation board, fiberglass, cellulose, sawdust, natural fibers, mineral fibers, drywall, plaster, stucco, and other similar construction materials known in the art.

In one embodiment, the elongate member 12 may be a construction element such as one or more construction elements including, but not limited to, a roofing element, a foundation element, a partition element, a wall element, and combinations thereof.

In an exemplary embodiment, the elongate member defines at least one open end. For example, the elongate member 12 may include an open first end 14 and an open second end 16. In a different exemplary embodiment, the elongate member defines at least one closed end. For example, the elongate member 12 may define an open first end 14 and a closed second end 16, or vice versa. In yet another exemplary embodiment, the elongate member 12 includes a closed first end 14 and a closed second end 16.

As previously stated, the elongate member 12 defines a cross-section 18 having any number of shapes. Accordingly, the cross-section 18 may have the shape of a square, a rectangle, a trapezoid, a circle, an oval, a triangle, a pentagon, a hexagon, a heptagon, an octagon, or any other geometric shape known in the art, including a star shape.

Figure 6:
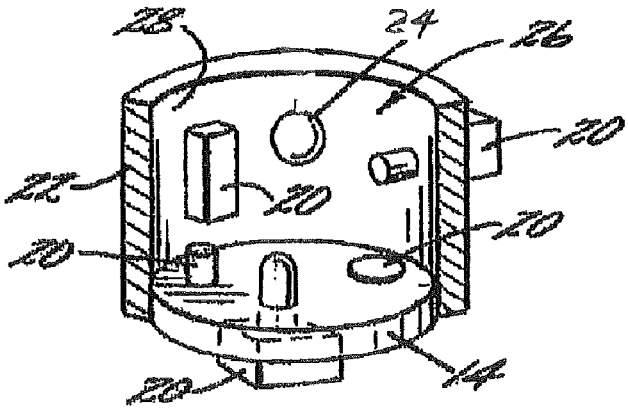
FIG. 6 is a representative depiction of the various positioning options of a sensor in accordance with the present invention.

In one embodiment, the elongate member 12 defines an external surface 22 that may include one or more openings 24, as depicted in FIG. 6. The openings 24 may be drilled, machined, molded, or cast integral to the elongate member 12. The elongate member 12 may also define a cavity 26 and an internal surface 28. In one exemplary embodiment, the openings 24 may extend from the external surface through the body of the elongate member 12, and into the cavity 26. In this embodiment, the openings 24 may facilitate communication between the cavity 26 and the external surface 22. Additionally, the openings 24 may serve to facilitate communication between the cavity 26 of one elongate member 12 and an additional elongate member. For example, the openings 24 may facilitate the transfer of fluids, gases, particulates, vapors, solids, bacterium, viruses, and combinations thereof between elongate members.

Figure 2:
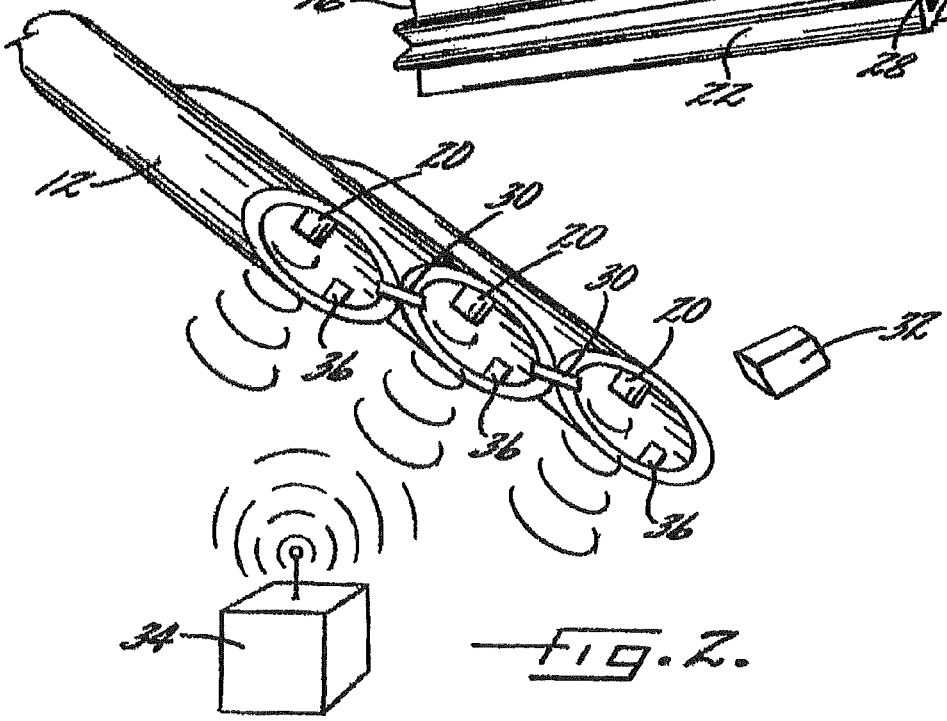
FIG. 2 is a representative depiction of communication between the elongate members in accordance with the present invention.

Referring to FIG. 2, the structural member 10 further includes a sensor 20 that is secured to the elongate member 12 and is capable of detecting at least one pre-selected indicator. As used herein, the term "indicator" refers to any number of events that evince (i.e., reflect) an environmental change. Those having ordinary skill in the art will recognize that the composition of an environment includes many components, (i.e., aspects of the environment), some of which reflect matter-based components of the environment (e.g., gaseous components, viral components) and some of which reflect physical components of the environment (e.g., electrical components, pressure components). For example, a change in one or more component in the environment may evince an environmental change.

Components of a particular indicator in accordance with the present invention may be either matter-based or physical-based. For example, one or more of the components may be a gaseous component, a vapor component, a liquid component, a solid component, a particulate component, a bacterial component, a viral component, an electrical component, a force component, a thermodynamic component, a pressure component, and combinations thereof. For example, the sensor may detect changes in pressure, introduction of a viral agent, changes in temperature, and changes in the composition of the environment, as well as other changes in environmental conditions.

In an exemplary embodiment, the sensor 20 may be connected to the elongate member 12 in a position such that the sensor 20 may be exposed to the pre-selected indicator. For example, the sensor 20 may be connected to the internal surface 28 of the elongate member, the external surface 22 of the elongate member, the first end 14 of the elongate member, the second end 16 of the elongate member, or some combination thereof. In one non-limiting example, the sensor 20 may detect the presence of a bioweapon and flood the internal cavity 26 with a substance capable of counteracting the bioweapon.

In a novel embodiment of the invention, the elongate member 12 is responsive to the pre-selected indicator. As used herein, the term "responsive" is intended to include any positive or negative reaction to the detection of a pre-selected indicator. In another exemplary embodiment, the elongate member 12 is dynamically responsive to the pre-selected indicator. As used herein, the term "dynamically responsive" refers to a productive reaction to the detection of the pre-selected indicator. For example, a dynamic response to the sensing of a bioweapon may include flooding the internal cavity 26 of an elongate member 12 with a substance capable of counteracting the bioweapon.

The sensor 20 may facilitate communication between the elongate member 12 and at least one additional elongate member. For example, the sensor 20 may communicate a desired response to a detected indicator to the additional elongate member.

In an exemplary embodiment, the sensor 20 detects environmental changes occurring substantially adjacent to the elongate member 12. In yet another exemplary embodiment, the sensor 20 monitors environmental conditions occurring substantially adjacent to the elongate member 12. It will be understood that "substantially adjacent" may or may not imply contact, but always implies the absence of anything of the same kind in between.

Also referring to FIG. 2, the structural element 10 may further include at least one connector 30 for securing (e.g., permanently or releasably) the elongate member 12 to one or more other elongate members incorporated into a structure. In one, embodiment, the connector 30 may be secured to the first end 14 of the elongate member 12, such that one end of the elongate member 12 is connected to another end of a different elongate member (e.g., a first end of one elongate member connected to a first end of another elongate member). In another embodiment, the connector 30 may be secured to the second end 16 of the elongate member 12. For example, the first end 14 of one elongate member 12 may be connected to the second end of a different elongate member. In yet another embodiment, the connector 30 may be secured to the external surface 22 of the elongate member 12 (i.e., the internal surface or the external surface).

In another embodiment, as depicted in FIG. 2, the structural element 10 may include at least one transmitter 32. The transmitter 32 may be remote from the structural element (as shown) or may be secured to one surface of the elongate member 12 (e.g., the transmitter 32 may be secured to the external surface 22 or the internal surface 28 of the elongate member 12). The transmitter 32 is preferably in communication with the sensor 20. For example, the transmitter 32 may be in signal communication with the sensor via a wireless network or conventional local area network (LAN). The structural element 10 may also include at least one remote processor 34 in communication (e.g., signal communication, as previously discussed) with the sensor 20. The communication between the processor 34 and the sensor 20 may be facilitated by the transmitter 32.

Referring to FIG. 2, the structural element 10 may include at least one receiver 36, in communication (e.g., signal communication) with the sensor 20 and the processor 34. The receiver may be secured to at least one surface of the elongate member 12 (i.e., internal surface 28 or external surface 22).

In an exemplary embodiment, the transmitter 32 may communicate changes in the pre-selected indicators—detected by the sensor 20—to the processor 34. The processor 34 may then analyze any changes in the pre-selected indicators and communicate with the receiver 36. In this embodiment, the processor 34 may communicate desired actions to the receiver 36 to effect dynamic changes with respect to the elongate member 12.

Figure 5:
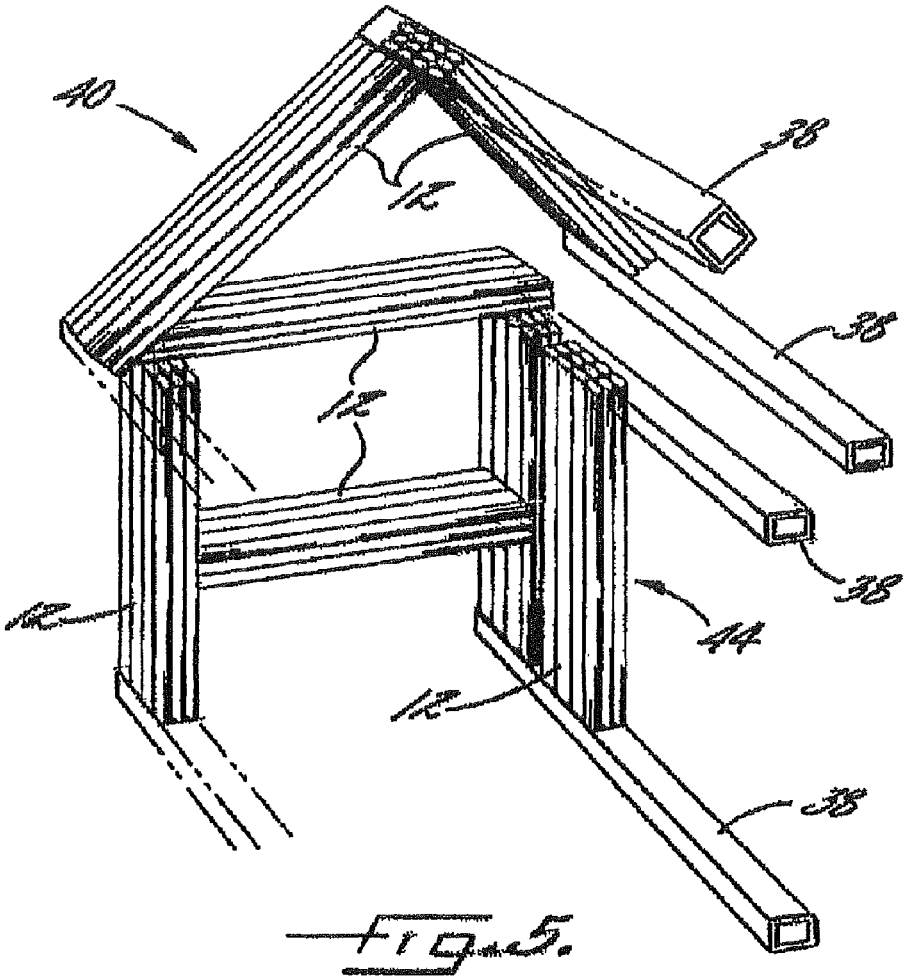
FIG. 5 is a representative structure, including a manifold, in accordance with the present invention.

Referring to FIG. 5, the structural element 10 may also include a manifold 38 that is secured, either releasably or permanently, to a portion of the elongate member 12. The manifold 38 facilitates communication between one or more elongate members 12. The manifold 38 may also be in communication with the internal cavity 26 of one or more elongate members 12 to further facilitate communication between the elongate members 12. For example, the manifold 38 may distribute fluids substantially evenly through more than one elongate member 12. Stated differently, the manifold 38 may also distribute gases, vapors, liquids, particulates, plasma, photons, electromagnetic fields, and/or electric fields through one or more elongate members 12, thereby delivering or advancing the distributed components across multiple elongate members.

Figure 3:
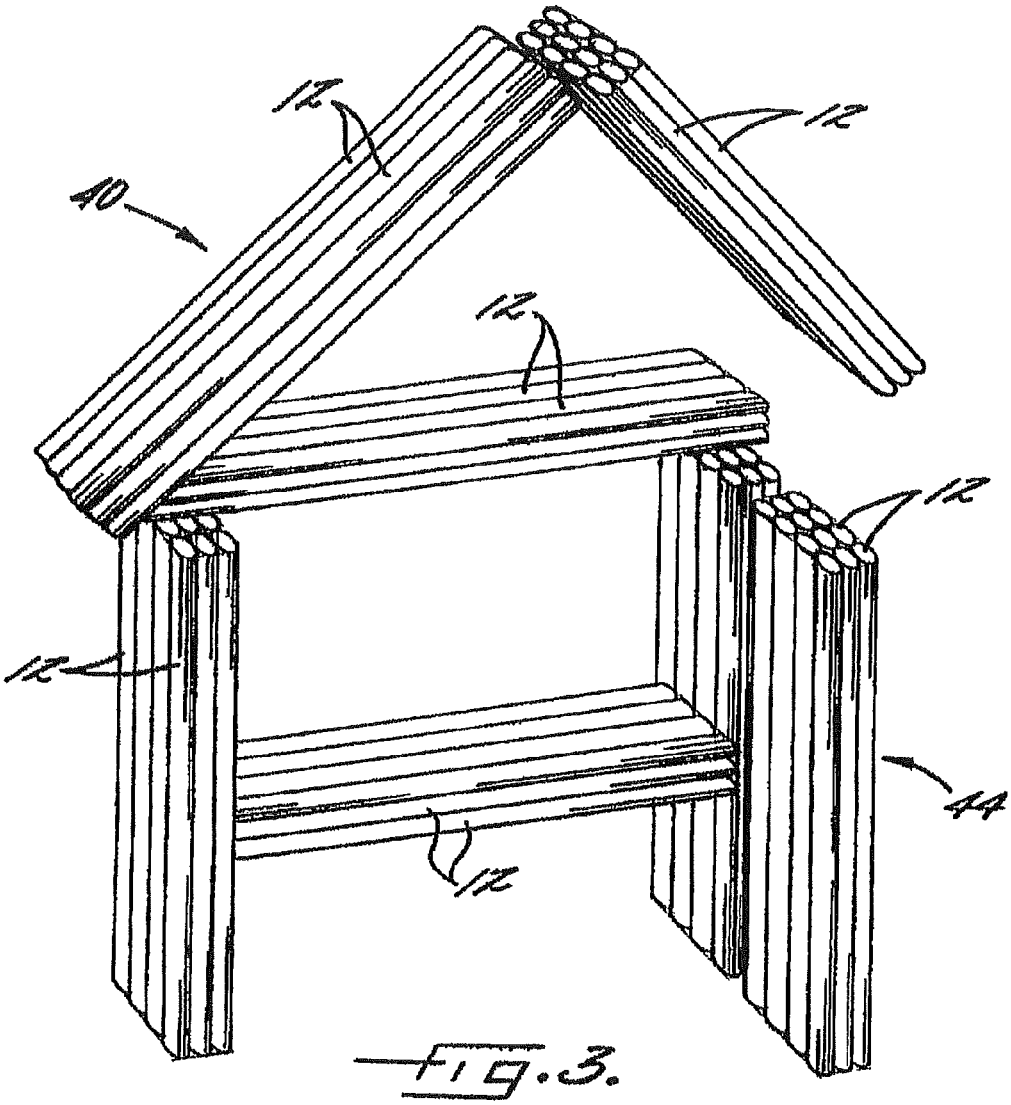
FIG. 3 is a representative structure in accordance with the present invention.

In another aspect, as depicted in FIG. 3, the invention is a structure 40 including at least one elongate member 12 having a first end 14 and a second end 16. Additionally, the elongate member 12 defines a cross-section 18, an internal surface 28, and an external surface 22. The structure 40 also includes a sensor 20 that may be secured to one surface of the elongate member 12. For example, the sensor may be secured to the external surface 22 of the elongate member 12, the internal surface 28 of the elongate member 12, the first end 14 of the elongate member 12, the second end of the elongate member 12, or combinations thereof. As previously discussed, the sensor serves to detect at least one pre-selected indicator. The structure 40 further includes at least one connector 30 for securing at least one elongate member 12 to at least one additional elongate member.

Figure 4:
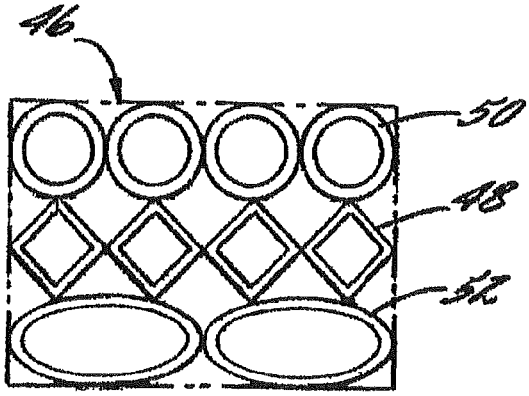
FIG. 4 is a representative cross-section of a wall of a structure formed in accordance with the present invention.

As depicted in FIG. 4, the structure 40 may include a wall 44 having a structural cross section 46 that may include elongate members 12 having different shapes. In one embodiment, and as depicted in FIG. 4, each row of elongate members 12 may have a different shape. Alternatively, the elongate members 12 may have the same shape or may have a random distribution of shapes.

It may be desirable to form differently shaped elongate members 12 for different functions. In this embodiment, the structure 40 may include elongate members 12 and sensors 40 designed to recognize differing pre-selected indicators and provide differing responses depending upon the identity of the detected indicator. In a non-limiting example, a square elongate member 48 that may detect matter-based components, a circular elongate member 50 that may detect physical components of the environment, and an elliptical elongate member 52 that also may detect physical components may be included in a wall 44.

The structure may also include a manifold 38, depicted in FIG. 5, for connecting at least one of the elongate members 12 to at least one additional elongate member. The manifold may also facilitate communication (e.g., fluid communication, gaseous communication, signal communication) between the elongate members. In yet another embodiment, the manifold 38 facilitates communication between one or more sensors 20, transmitters 32, receivers 36, and processors 34. The manifold 38 may communicate change in the external environment to the different elongate members. The manifold 38 may also distribute gases, vapors, liquids, particulates, plasma, photons, electromagnetic fields, and/or electric fields through one or more elongate members 12, thereby delivering or advancing the distributed components across multiple elongate members.

The elongate members 12 may be connected to one another with at least one connector 30. For example, the connector 30 may include, but is not limited to a mechanical fastener, an adhesive, a wrapping, a binding, a clip, a restraint, a pressure device, a fusing devices, a vacuum device, a gravity device, an electromagnetic device, an electrostatic device, and combinations thereof.

In an exemplary embodiment, the structure 40 may be one or more of a house, an apartment, condominiums, a business, a storage container, a hospital, a government building, a school, an athletic facility, an airport, a hangar, a bunker, and combinations thereof.

As depicted in FIG. 6, the sensor 20 may be positioned at any number of locations on the elongate member 12 forming part of the structure. For example, the sensor may be positioned on one or more of an internal surface 28 of the elongate member 12, an external surface 22 of the elongate member 12, the first end 14 of the elongate member 12, the second end 16 of the elongate member 12. In further non-liming examples, the sensor 20 may be positioned to extend through openings 24 in the elongate member 12, suspend in the cavity 26 of the elongate member 12, and the like.

In another aspect, the invention is a method for protecting an internal environment. The method includes providing a plurality of elongate members 12 (as discussed above) and at least one sensor 20 capable of detecting at least one pre-selected indicator, such as those indicators previously discussed. The method further includes assembling the elongate members into a structure 40 such that the sensor 20 is secured to at least one elongate member 12. In this aspect, the method also includes engaging the sensor 20 to detect at least one pre-selected indicator and to respond to the indicator, such that the sensor 20 facilitates maintenance of a desired internal environment within the structure 40. For example, the sensor 20 may detect the presence of a bioweapon and may flood the internal cavities 26 with a substance that will counteract the bioweapon and will prevent penetration of the bioweapon into the internal environment.

The step of assembling the elongate members 12 into a structure 40 may include assembling the elongate members such that the manifold 38 connects the elongate members to facilitate communication among and between the elongate members.

The assembling step may be conducted by attaching the elongate members to each other and/or to the manifold, using at least one connector 30 chosen from one or more mechanical fasteners, fusing devices, wrappings, restraints, pressure devices, vacuum devices, gravity devices, electromagnetic devices, and electrostatic devices. Other connectors 30 may include one or more anchors, bolts, screws, nails, adhesives, straps, bindings, recesses, notches, clips, tapes, tie-downs, embedding materials, plates, ropes, wires, cables, male-female plugs, epoxies, urethanes, acrylics, vinyls, cements, ceramic cements, weldments, threaded or machined devices to match complementary threaded or machined portions, combinations thereof, and the like.

Additionally, the assembling step may include attaching the elongate members 12 to any other material, element, or structure. The step of attaching the elongate members 12 to any other material, element, or structure may include the use of connectors 30 chosen from one or more mechanical fasteners, fusing devices, wrappings, restraints, pressure devices, vacuum devices, gravity devices, electromagnetic devices, and electrostatic devices. Other connectors 30 may include anchors, bolts, screws, nails, adhesives, straps, bindings, recesses, notches, clips, tapes, tie-downs, embedding materials, plates, ropes, wires, cables, male-female plugs, epoxies, urethanes, acrylics, vinyls, cements, ceramic cements, weldments, threaded or machined devices to match complementary threaded or machined portions, combinations thereof, and the like.

Figure 7:
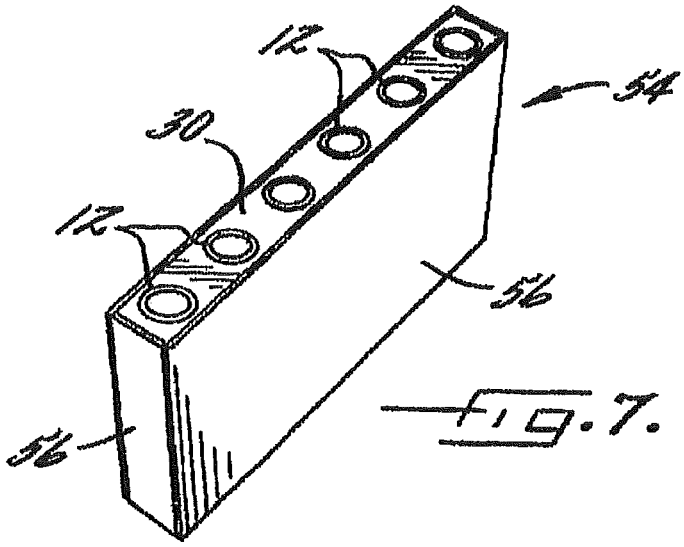
FIG. 7 is a representative depiction of a nesting configuration in accordance with the present invention.
Figure 8:
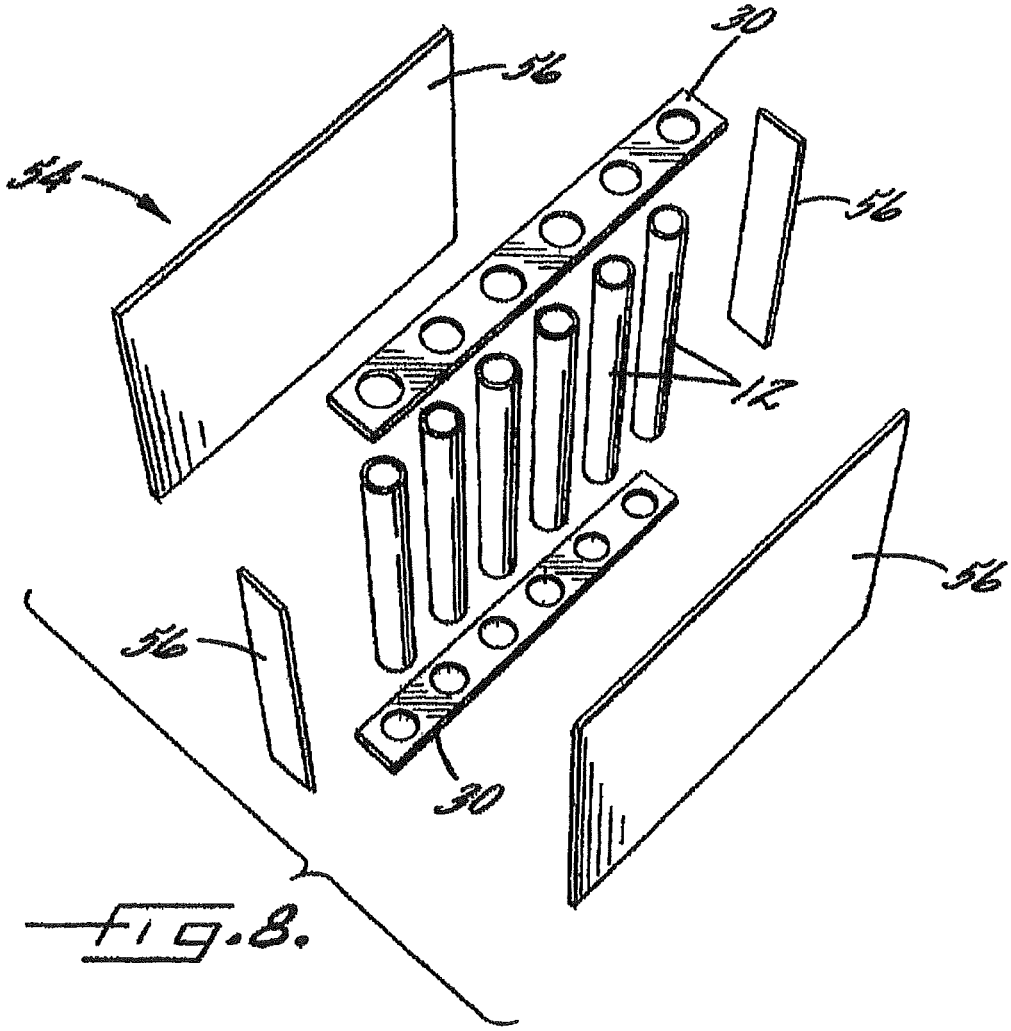
FIG. 8 is a representative expanded depiction of a nesting configuration in accordance with the present invention.

Referring to FIGS. 7 and 8, the assembling step may also include assembling the elongate members 12 in a nesting configuration 54. In this example, the nesting configuration includes more than one elongate member 12 in an enclosure 56. This nesting configuration may lead to improved communication between the elongate members as well as improved ease of assembly.

In a similar embodiment, elongate members 12 having different functionality may be nested together as depicted in FIG. 4 to provide improved functionality and ease of assembly.

In one embodiment, the step of engaging the sensor to detect at least one pre-selected indicator includes engaging the sensor to detect at least a change in one component of a pre-selected indicator, such as those discussed above, from an environment external to the structure.

In one example, the step of engaging the sensor to detect a pre-selected indicator and to respond to the indicator may include blocking harmful substances in an external environment from entering the internal environment. The harmful substances may be blocked by filling the cavities 26 of the elongate members 12 with a composition that is capable of counteracting or neutralizing the harmful substance. The composition may be stored in external tanks prior to their use, wherein the tanks are in communication with one or more manifolds 38, sensors 20, transmitters, 32, receivers 36, or combinations thereof.

In another example, the step of engaging the sensor to detect at least one pre-selected indicator and to respond to the indicator may include maintaining a substantially constant temperature in the internal environment by altering a thermal transfer rate from an external environment to the internal environment.

In yet another example, the step of engaging the sensor to detect at least one pre-selected indicator and to respond to the indicator comprises dynamically responding to a bioweapon release in the external environment by flooding the cavities within the elongate members with chemical gases, vapors, liquids, electromagnetic energy, photonic energy, plasma, or sonic energy to prevent penetration of the bioweapon into the internal environment.

Stated differently, the method of the present invention includes the formation of a structure that may be designed to provide a barrier against the penetration of one or more of gases, vapors, liquids, bacteria, viruses, spores, combinations thereof, and the like, into an internal environment. The structure design may also provide protection to inhabitants and/or objects within the structure against dangerous environmental changes including, but not limited to, extreme weather events (e.g., hurricanes, tornadoes, or floods) and epidemics or contaminants passed through the environment (e.g., flu, viruses, bacteria, or poisons). In a broad sense, the structure would provide a barrier to fire, heat, cold, wind, water, contaminants, and abrasives.

In one embodiment, each structure 40 could be designed to counteract particular environmental changes. For example, structures in large cities may be designed to counteract bioweapon attacks such that the cavities may be infused with appropriate compositions when a bioweapon is detected. Structures 40 in flood zones may be designed with elongate members 12 that may absorb water and/or repel water to prevent infusion of the water into the internal environment. Elongate members may be designed to be fire retardant, wind resistant, or resistant to other environmental changes based on the particular need.

In another embodiment, the sensor 20, the transmitter 32, the processor 34, and the receiver 36 may be capable of communication with other devices, such as additional processors 34, for the purpose of information transfer and storage, actuation of other devices, sensing of environmental conditions, and dynamic response.

In yet another embodiment, the structure may provide for the conversion of environmental changes into useful formats, such as using excess energy to heat water, converting excess energy to electricity, or converting a pressure differential within the external environment into a stored energy form.

In the specification, drawings, and examples, there have been disclosed typical embodiments of the invention and, although specific terms have been employed, they have been used in a generic and descriptive sense only and not for purposes of limitation, the scope of the invention being set forth in the following claims.

The invention claimed is:

1. A method of protecting an internal environment, the method comprising:

providing a plurality of elongate members and at least one sensor capable of detecting at least one pre-selected indicator, said elongate member being responsive to said at least one pre-selected indicator, wherein an internal surface of said elongate member defines a cavity capable of accepting a substance as a result of the detection of said at least one pre-selected indicator;

assembling the elongate members into a barrier to prevent entry of a harmful substance from an external environment into an internal environment such that the sensor is secured to at least one elongate member, wherein assembling the elongate members into a barrier involves providing a manifold and connecting the elongate members to the manifold to facilitate communication among the elongate members; and engaging the sensor to detect at least one pre-selected indicator and to respond to the indicator, such that the sensor facilitates maintenance of a desired internal environment within the structure; and filling the cavity with said substance, wherein said substance is capable of neutralizing said harmful substance.

2. A method according to claim 1, wherein the step of engaging the sensor to detect at least one pre-selected indicator comprises utilizing the sensor to detect at least a change in one pre-selected indicator from an environment external to the structure.

3. A method according to claim 1, wherein the step of providing a plurality of elongate members comprises:

providing at least one sensor secured to at least one elongate member;

wherein the sensor is capable of detecting at least one pre-selected indicator; and wherein one or more components of said pre-selected indicators are selected from the group consisting of a gaseous component, a vapor component, a liquid component, a solid component, a particulate component, a bacterial component, a viral component, an electrical component, a force component, a thermodynamic component, pressure component, and combinations thereof.

4. A method according to claim 1, wherein the step of assembling the elongate members into a structure comprises constructing the elongate members into a structure selected from the group consisting of homes, apartments, condominiums, businesses, storage containers, hospitals, government buildings, schools, athletic facilities, airports, hangars, bunkers, and combinations thereof.

5. A method according to claim 1, wherein the step of assembling the elongate members into a structure comprises attaching the elongate members to one another with at least one connector selected from the group consisting of mechanical fasteners, fusing devices, adhesives, wrappings, bindings, clips, restraints, pressure devices, vacuum devices, gravity devices, electromagnetic devices, electrostatic devices, and combinations thereof.

6. A method according to claim 1, wherein the step of engaging the sensor comprises maintaining a substantially constant temperature in the internal environment by altering a thermal transfer rate from an external environment to the internal environment.

7. A method according to claim 1, wherein the step of engaging the sensor comprises dynamically responding to a bioweapon release in the external environment by flooding the at least one cavity within an elongate member with chemical gases, vapors, liquids, electromagnetic energy, photonic energy, plasma, or sonic energy to prevent penetration of the bioweapon into the internal environment.

8. A method according to claim 1, wherein the step of assembling the elongate members into a structure comprises:

constructing a nesting configuration including elongate members and an enclosure; and combining more than one nesting configuration to form a structure with a protected internal environment.

9. A method according to claim 1, wherein the step of assembling the elongate members into a structure comprises attaching the elongate members to one another with at least one connector selected from the group consisting of one or more anchors, bolts, screws, nails, adhesives, straps, bindings, recesses, notches, clips, tapes, tie-downs, embedding materials, plates, ropes, wires, cables, male-female plugs, epoxies, urethanes, acrylics, vinyls, cements, ceramic cements, weldments, threaded or machined devices to match complementary threaded or machined portions, combinations thereof, and the like.

* * * * *